US005161683A

United States Patent [19]

Smith

[11] Patent Number: 5,161,683

[45] Date of Patent: Nov. 10, 1992

[54] PROTECTED TOWEL ASSEMBLY

[75] Inventor: Robert G. Smith, Pueblo, Colo.

[73] Assignee: Trustee of "The Terry Family Trust"

[21] Appl. No.: 835,371

[22] Filed: Feb. 14, 1992

[51] Int. Cl.[5] ..... A47K 10/12; A63B 47/04

[52] U.S. Cl. ..... 206/315.1; 206/492; 206/493; 206/494; 206/812; 150/154

[58] Field of Search ..... 206/581, 315.1, 460, 206/491, 492, 493, 494, 495, 812; 15/209 R; 150/154

[56] References Cited

U.S. PATENT DOCUMENTS

| | | | |
|---|---|---|---|
| 1,554,178 | 9/1925 | Sickels | 206/494 |
| 3,144,721 | 8/1964 | Woloz | 206/494 X |
| 3,612,264 | 10/1971 | Trunick | 206/494 X |
| 4,403,366 | 9/1983 | Lucke | 15/209 R |
| 4,516,616 | 5/1985 | Fesler | 206/315.9 X |
| 4,771,502 | 9/1988 | Trimble | 15/201 R |
| 4,953,603 | 9/1990 | Holden | 150/154 |

FOREIGN PATENT DOCUMENTS 83661 3/1954 Norway .

*Primary Examiner*—Paul T. Sewell
*Assistant Examiner*—Jacob K. Ackun, Jr.
*Attorney, Agent, or Firm*—Bill B. Berryhill

[57] ABSTRACT

A protected towel assembly for providing the user thereof with a protectively enclosed towel. The assembly may include a towel, an enclosure and a connector connecting the towel and enclosure for cooperative suspension from a selected object. The enclosure is formed from a sheet of water impervious material which, when folded, provides a protective enclosure around the towel which may be opened along a side to expose the towel for use.

9 Claims, 2 Drawing Sheets

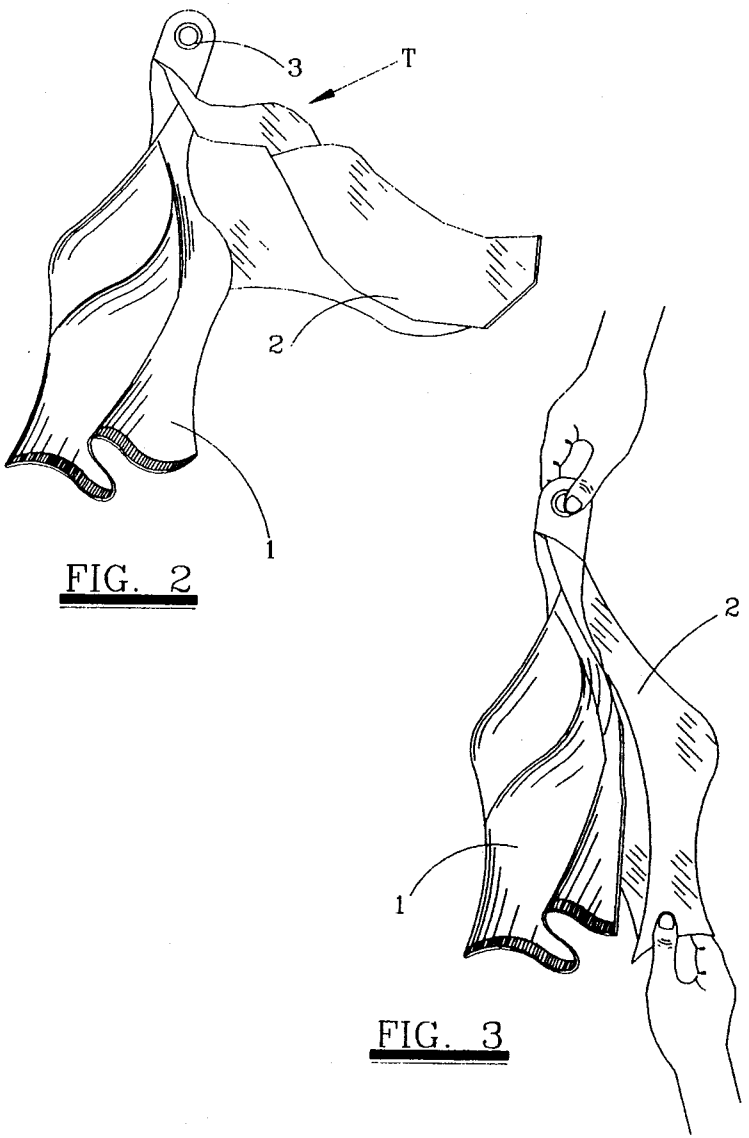
FIG. 2
FIG. 3
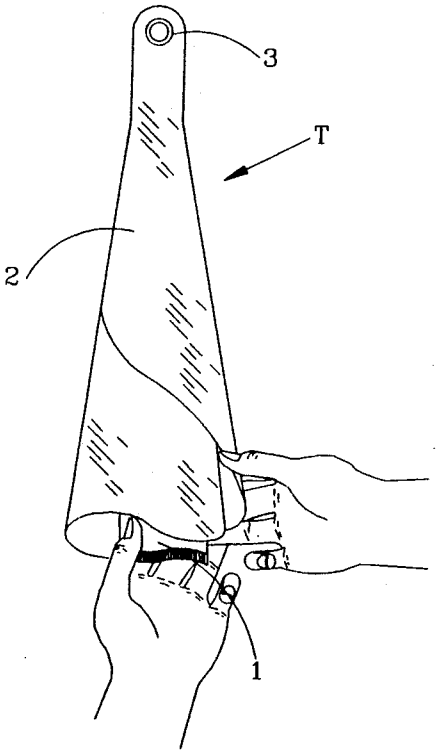
FIG. 1

PROTECTED TOWEL ASSEMBLY

BACKGROUND OF THE INVENTION

1. Field of the Invention

The present invention pertains to a protected towel assembly in which a towel and protective cover are provided for suspension from a selected object. More specifically, the present invention pertains to a protected towel assembly particularly useful for attachment to a golf cart or golf bag to provide the user thereof with a moist towel.

2. Description of the Prior Art

There are many hobbies, occupations and avocations in which it is desirable to have a towel close at hand. Examples of such are golfing, fishing, bowling, yard work, shop work, etc. In golfing, it is desirable to clean the golf clubs with a damp towel prior to their return to a golf bag. However, if a damp towel is suspended from the golf cart or golf bag, it would be dried out long before completion of a round of golf because of exposure to the atmosphere and wind blowing therethrough.

Some golfers are more concerned with a towel becoming soaked due to unexpected rain. Such concerns are expressed in U.S. Pat. Nos. 4,516,616 and 4,953,603 in which protected towel assemblies are disclosed to keep a towel dry. In U.S. Pat. No 4,516,616, a towel is suspended within a water resistant cover which assumes the shape of a pleated cone. The user reaches upwardly under the cover to grasp a dry towel therein. In U.S. Pat. No. 4,953,603 a towel is contained in a protective cover shaped similar to a paper bag, the bottom of which has been removed. Access to the towel is obtained through the bottom of the bag.

While both of the aforementioned patents appear to be effective in keeping a towel dry, they would not be as effective in keeping a towel moist or damp because they both provide large openings at the bottoms thereof through which air may easily enter and circulate to dry the towel. Furthermore, use of the towel in either one of these devices requires reaching underneath the protective covers and somewhat limits use of the towel to the lower end thereof.

SUMMARY OF THE PRESENT INVENTION

In the present invention a protected towel assembly is provided which includes a towel, a protective enclosure and connector means, connecting the towel and enclosure for cooperative suspension from a selected object such as a golf cart or golf bag. The protective enclosure is formed from a sheet of water impervious material which is folded in such a manner as to provide a protective envelope which may be opened along a side thereof to provide access to the towel. Thus, the towel may be kept moist for long periods of time yet is easily accessible for cleaning of golf clubs, the users hands, etc.

The manufacture and assembly of the towel assembly of the present invention is relatively simple, providing a useful and efficient protected towel assembly at a relatively low cost. Many other objects and advantages of the invention will be apparent from reading the description which follows in conjuction with the accompanying drawings.

BRIEF DESCRIPTION OF THE DRAWINGS

FIG. 1 is a pictoral illustration of a protected towel assembly, according to a preferred embodiment of the invention, showing the towel assembly as it would be suspended from a selected object just prior to use;

FIG. 2 is a pictoral illustration of the towel assembly of the present invention illustrating opening of the protective enclosure thereof for use;

FIG. 3 is a pictoral illustration of the towel assembly of the present invention illustrating closing of the protective enclosure after use of the towel therein;

DESCRIPTION OF A PREFERRED EMBODIMENT

Referring first to FIG. 1 there is shown a protected towel assembly T in which a towel 1 is surrounded by an enclosure 2 and connected by a connector 3 for cooperative suspension from a selected object (not shown) such as a golf cart or golf bag. FIGS. 1, 2 and 3 illustrate use of the protected towel assembly T which will be further described hereafter.

Figure 4:
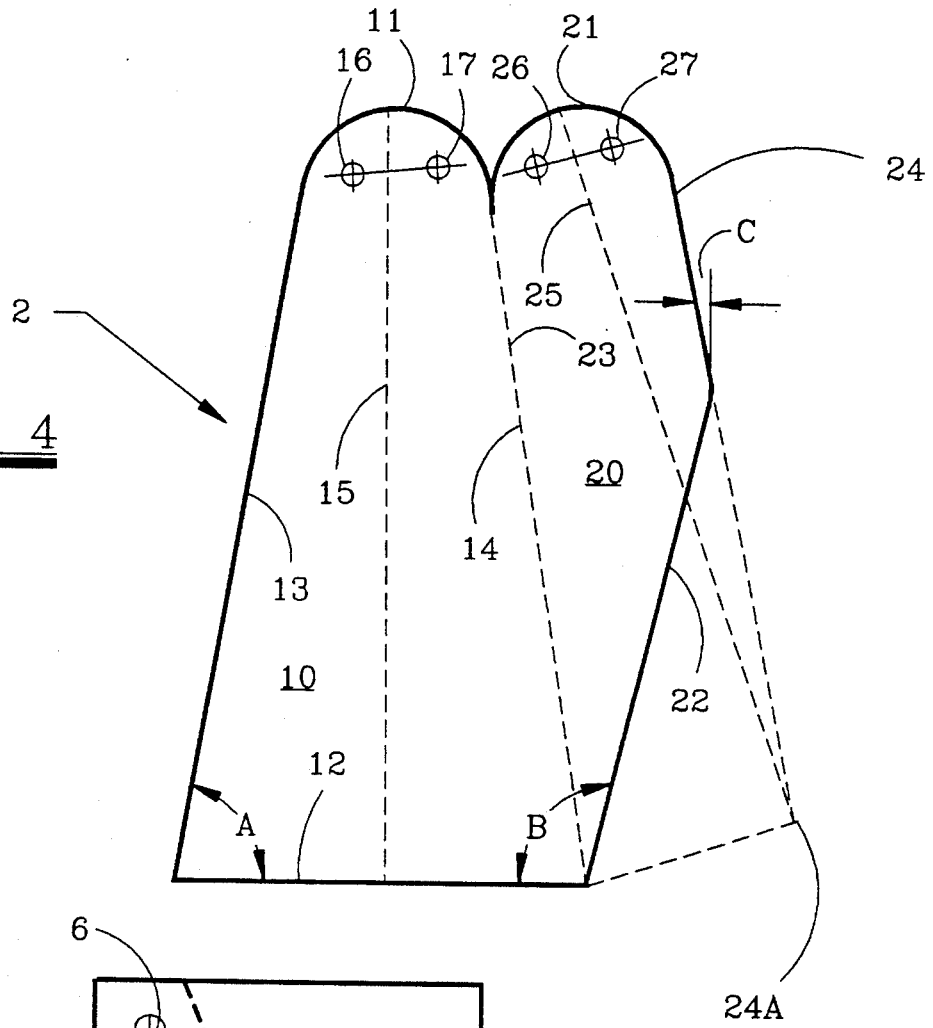
FIG. 4 is a plan view of a sheet of material from which the protective enclosure of the protected towel assembly of the present invention may be formed, according to a preferred embodiment of the invention.

Referring now to FIG. 4, the protective enclosure 2 may be formed from a sheet of water impervious material, e.g., polyethylene, which, when flat, forms a first panel 10 which generally conforms to a first isosceles triangle, except that the vertex would be replaced by a rounded portion 11 (radius about two inches). The base 12 of the panel or triangle 10 is shorter than its sides 13 and 14. Adjoining the first panel 10 is a second panel 20 which generally conforms to a similar, perhaps smaller, second isosceles triangle, the upper vertex of which is replaced by rounded end 21 (radius about two inches) and one side 23 of which is common with one side 14 of the first panel 10. A lower portion of the second isosceles triangle or panel 20 is removed along a line 22 extending diagonally from the lower terminus of the common sides 14 and 23 to a point substantially midway of the other side 24, as it might be projected to a corresponding terminus 24*a*. The upper end of each of the panels 10 and 20 is provided with a pair of holes or apertures 16, 17 and 26, 27, respectively.

The location of the holes 16, 17, 26, 27 and some of the angles cut in the formation of the enclosure 2 are important. When laid out as shown, with the base 12 oriented horizontally, the angle A between base 12 and side 13 is preferably about fifteen degrees (15), the angle B between the base 12 and the line 22 is preferably about one hundred and one degrees (101°) and the angle C between side 24 and a vertical line is preferably about fifteen degrees (15°). A line drawn through the centers of holes 16 and 17 lie at an angle, relative to the horizontal, of preferably about five degrees (5°) and a line drawn through the centers of holes 26 and 27 lie at an angle, relative to the horizontal, of preferably about fifteen degrees (15°).

To form the enclosure 2 so as to appear as in FIG. 1, the sheet of water impervious material is folded along a mid-line 15 of the first panel 10, along the common sides 14, 23 and along a line 25 of the second panel 20 to form an enclosure around the towel 1. The location of the line 25 may vary somewhat. As illustrated in FIG. 4, it would project generally from between apertures 26 and 27 toward the imaginary terminus 24a so that an angle d between the line 25 and a line parallel to the first panel base 12 would be preferably about twenty-five degrees (25°).

Figure 5:
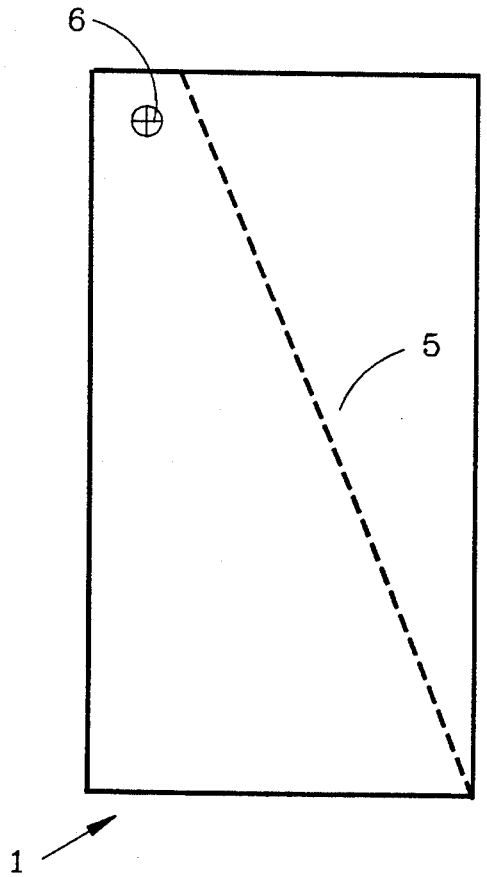
FIG. 5 is a plan view of a finger towel of the type utilized with the protected towel assembly of the present invention and illustrating how it would be folded for use therewith.

Referring now to FIG. 5, there is shown a finger-tip type towel 1, basically rectangular in shape, for use in the present invention. Prior to assembly, the towel 1 may be folded or cut along a diagonal line 5 and provided with a hole or aperture 6 in an upper corner thereof. The towel 1 then assumes a shape generally conforming to a right triangle, substantially similar to one side of said first panel 10.

To put the assembly T together, the male section of a grommet would be inserted through the holes 17 of panel 10 and the hole 6 of the towel 1. Then the first fold of the cover 2 would be made along line 15 so that the folded towel 1 is then sandwiched between opposite portions of the first panel 10. Then the second fold would be made along lines 14, 23 at which time holes 16, 17 and 21 would be coaxially aligned and engaged by the male portion of the grommet. Finally, the third fold would be made along line 25. As this is done, the male portion of the grommet is removed so that the hole 27 can be aligned with hole 16, 17 and 21. Then the male grommet is reinserted into all of the coaxially aligned holes 6, 16, 17, 26 and 27 and the female portion of the grommet attached thereto so that the protected towel assembly will then appear as shown in FIG. 1 and may be suspended by the grommet 3 from a chain, hook or the like (not shown) passed through the grommet 3 and attached to a golf bag or golf cart (not shown).

Referring now to FIGS. 1, 2 and 3, use of the towel assembly T of the present invention will be explained. Initially, the towel assembly T would be suspended as shown in FIG. 1. The user would grasp the lower end of the towel 1 with one hand and a lower corner of the enclosure 2 with the other hand. Then the hands would be separated as illustrated by the arrows in FIG. 1. As this is done, the enclosure 2 would be opened along a side, this opening being defined by the free edge 13 of the first panel 10 and the free edges 22 and 24 of the second panel 20 (See FIG. 4) leaving complete access to the towel 1 as shown in FIG. 2.

After the towel 1 is used to clean golf clubs, the hands, etc., the user might grasp the upper part of the towel assembly with one hand and with the other hand one lower corner of the protective enclosure 2, as shown in FIG. 3. A sharp tug on the corner of the enclosure 2 will cause the enclosure to reassume its initially folded or closed state as shown in FIG. 1.

Thus, the towel 1 can be moistened, prior to beginning a round of golf or the like, and maintained within the enclosure 2 until needed. The water impervious material of enclosure 2 prevents escape of moisture from the towel and protects the towel from drying air circulation. When the towel is needed, it is a simple matter to grasp the towel and open the enclosure as illustrated in FIGS. 1 and 2 and to close the enclosure, as illustrated in FIG. 3, after the towel is used. Its use is very simple and effective.

The design of the protective enclosure 2 is particularly unique. The side opening of the enclosure 2 allows more access for the towel 1 than in prior art designs. The flat folded construction of the enclosure 2 is more compact and less obtrusive than the prior art. In addition, this arrangement closely envelopes the towel 1 to inhibit air circulation and premature drying of the towel therefrom.

A single embodiment of the invention has been described herein. However, many variations thereof can be made without departing from the spirit from the invention. Accordingly, it is intended that the scope of the invention be limited only by the claims which follow.

I claim:

1. A protected towel assembly for providing the user thereof with a protectively enclosed towel, said assembly comprising:

a towel;

a protective enclosure; and connector means for connecting said towel and said protective enclosure for cooperative suspension from a selected object; and in which said enclosure is formed from a sheet of water impervious material which, when flat, forms a first panel which generally conforms to a first isosceles triangle the base of which is shorter than its sides and a second panel which generally conforms to a similar second isosceles triangle one side of which is common with one side of said first isosceles triangle, a lower portion of said second isosceles triangle being removed along a line extending diagonally from the lower terminus of said common side to a point substantially midway of the other side of said second isosceles triangle, said sheet being folded along a midline of said first panel, along the common sides of said panels and along another line on said second panel to form said protective enclosure around said towel.

2. A protected towel assembly as set forth in claim 1 in which the upper ends of said first and second panels are provided with a plurality of apertures all of which are coaxially aligned when said enclosure is folded for engagement by said connector means.

3. A protected towel assembly as set forth in claim 1 in which said protective enclosure may be opened to expose said towel for use, said opening being at least partially defined by a free edge along one side of said first panel and a free edge along said diagonally extending line of said second panel.

4. A protected towel assembly as set forth in claim 3 in which said enclosure may be closed, after use of said towel, by application of a force on a lower corner of said enclosure.

5. A protected towel assembly as set forth in claim 1 in which said towel is folded or cut to assume a shape generally conforming to a right triangle substantially similar to one side of said first panel, the upper end of said towel being connected to the upper end of said enclosure by said connector means.

6. A protected towel assembly as set forth in claim 5 in which said upper end of said towel and said upper end of said enclosure are provided with coaxially aligned holes for engagement by said connector means.

7. A protected towel assembly as set forth in claim 1 in which the angle between said first panel base and its sides is preferably about fifteen degrees (15°), the angle between said first panel base and said diagonally extending line of said second panel is preferably about one hundred and one degrees (101°) and the angle between said other side of said second panel and a line perpendicular to said first panel base is preferably about fifteen degrees (15°).

8. A protected towel assembly as set forth in claim 7 in which the angle between a line drawn through the center of two of said apertures in said first panel and a line parallel to said first panel base is preferably about five degrees (5°).

9. A protected towel assembly as set forth in claim 7 in which the angle of line drawn through the center of two of said apertures in said second panel and line parallel to said first panel base is preferably about fifteen degrees (15°).

* * * * *